US007962079B2

(12) United States Patent
Ogata

(10) Patent No.: US 7,962,079 B2
(45) Date of Patent: Jun. 14, 2011

(54) FIXING DEVICE AND IMAGE FORMING APPARATUS

(75) Inventor: Yasunobu Ogata, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 430 days.

(21) Appl. No.: 12/246,633

(22) Filed: Oct. 7, 2008

(65) Prior Publication Data

US 2009/0110452 A1 Apr. 30, 2009

(30) Foreign Application Priority Data

Oct. 26, 2007 (JP) ..... 2007-279143

(51) Int. Cl.
*G03G 15/20* (2006.01)

(52) U.S. Cl. ..... 399/323

(58) Field of Classification Search ..... 399/323, 399/398, 22

See application file for complete search history.

(56) References Cited

U.S. PATENT DOCUMENTS

2008/0193162 A1 8/2008 Yamazoe et al.

FOREIGN PATENT DOCUMENTS

| | | |
|---|---|---|
| JP | 2001-13834 | 1/2001 |
| JP | 2003-107919 | 4/2003 |
| JP | 2003-316187 | 11/2003 |
| JP | 2005-247564 | 9/2005 |
| JP | 2005-250033 | 9/2005 |
| JP | 2006-171551 | 6/2006 |
| JP | 2007-79485 | 3/2007 |

*Primary Examiner* — David M Gray
*Assistant Examiner* — Ruth N Labombard
(74) *Attorney, Agent, or Firm* — Oblon, Spivak, McClelland, Maier & Neustadt, L.L.P.

(57) ABSTRACT

A disclosed fixing device includes a fixing member configured to heat and melt a toner image to fix it onto a recording medium; a pressure member abutting the fixing member to form a nip into which the recording medium is fed; a separating member disposed on the downstream side in the moving direction of the fixing member in relation to the nip in a manner to oppose the fixing member, and configured to perform a separating operation to prevent the recording medium from winding around the fixing member; an electrically grounded frame supporting the fixing member, the pressure member and the separating member; and a conductive member inserted between a supporting portion of the frame and a supported portion of the separating member and having a higher electric resistance than the frame. The separating member and the frame are rendered electrically conductive to each other only via the conductive member.

15 Claims, 8 Drawing Sheets

FIXING DEVICE AND IMAGE FORMING APPARATUS

BACKGROUND OF THE INVENTION

1. Field of the Invention

The present invention relates to an image forming apparatus, such as a copying machine, a printing machine, a fax machine or a multi-function peripheral providing multiple functions of those machines, and also relates to a fixing device provided in such an image forming apparatus.

2. Description of the Related Art

Conventionally, as to a fixing device including in an image forming apparatus (e.g. a copying machine or a printing machine), a technology is known that provides a separating member (e.g. a separating plate) to oppose a fixing member in order to prevent a recording medium after a fixing operation from winding around the fixing member (see Patent Document 1, for example).

In a fixing device, a fixing member (e.g. a fixing roller or a fixing belt) abuts a pressure member (e.g. a pressure roller, a pressure belt or a pressure pad) by a pressure means, and a nip portion (fixing nip portion) is formed between these two members. The fixing member is heated by a heating means such as a heater or an exciting coil, and a toner image having been transferred onto a recording medium at a transfer unit is fed into the nip portion and then fixed onto the recording medium by heat and pressure.

In such a fixing device, a separating member is provided on the downstream side in the moving direction of the fixing member in relation to the nip portion in a manner to oppose the fixing member across a small gap. Even if a recording medium immediately after the fixing operation adheres to the fixing member, the separating member forces the recording medium to separate from the fixing member. Thus, the recording medium does not end up winding around the fixing member, and is guided to its conveyance path.

In Patent Document 1, for example, projections (position setting members) formed by a rolling process or a bending process are provided at both ends of the separating plate (separating member) in the width direction. The separating plate is urged toward the fixing member by a spring so as to bring the projections to abut the fixing member. In this way, a small gap is formed between the separating plate and the fixing member.

On the other hand, Patent Document 2, for example, discloses a technology that grounds, via a resistance, a driving roller of a transfer carrying belt and a front guide situated before the fixing member in order to prevent drops in a transfer bias voltage and also prevent an unfixed toner image on a recording medium from being dispersed by static electricity.

Patent Document 3, for example, discloses a technology that applies a bias between the fixing member and the pressure member in order to prevent current flowing them.

Patent Document 1: Japanese Laid-open Patent Application Publication No. 2006-171551

Patent Document 2: Japanese Laid-open Patent Application Publication No. 2003-107919

Patent Document 3: Japanese Laid-open Patent Application Publication No. 2003-316187

As to conventional fixing devices described above, in the case where the length of the recording medium along the conveyance direction is long in relation to the distance between the separating member and the transfer unit performing the toner-image transfer operation (i.e. in the case where the separating operation by the separating member is being carried out at the front end of the recording medium while the toner-image transfer operation by the transfer unit is being carried out at the rear end of the recording medium), a transfer current applied to the transfer unit flows to the separating member via the recording medium, thereby sometimes resulting in transfer defects at the transfer unit, such as defects in image transfer density. This problem becomes eminent particularly when the moisture content of the recording medium is high (for example, in the case of using a recording medium having a moisture content of 10% or more after having been stored for a long period of time in a high-humidity environment) since such a recording medium is prone to passing an electric current.

In particular, the separating member may come in direct contact with a transfer surface (i.e. fixing surface) of the recording medium with a large force when performing its function, and therefore the conventional fixing devices are subject to the above problem. In order to solve this problem, the separating member may be grounded via an electric resistor. However, providing an electric resistor leads to an increase in cost and size of the device. Particularly, in the case where the separating member is rotatably supported against the frame of the fixing device, as in Patent Document 1, connecting the electric resistor may interrupt the rotation of the separating member and result in changing the gap between the separating member and the fixing member. Or, enough space for providing the electric resistor may not be reserved.

Note that the above problem is not limited to the separating member of a fixing device. The same problem arises with, under the above-mentioned conditions, an opposing member that is disposed in the conveyance path of a recording medium so as to face the recording medium.

SUMMARY OF THE INVENTION

Accordingly, in view of the above-mentioned problem, there is a need to provide a fixing device and an image forming apparatus that prevent a reduction in the function of the separating member, an increase in cost and size, and transfer defects at the transfer unit, such as defects in image transfer density.

One embodiment of the present invention is a fixing device including a fixing member configured to heat and melt a toner image to fix the toner image onto a recording medium; a pressure member abutting the fixing member to form a nip portion into which the recording medium is fed; a separating member disposed on the downstream side in the moving direction of the fixing member in relation to the nip portion in a manner to oppose the fixing member, and configured to perform a separating operation to prevent the recording medium from winding around the fixing member; an electrically grounded frame supporting the fixing member, the pressure member and the separating member; and a conductive member inserted between a supporting portion of the frame and a supported portion of the separating member and having a higher electric resistance than the frame. The separating member and the frame are rendered electrically conductive to each other only via the conductive member.

Another embodiment of the present invention is an image forming apparatus having the above-mentioned fixing device.

Another embodiment of the present invention is an image forming apparatus including an opposing member disposed in a conveyance path of a recording medium so as to face the recording medium; an electrically grounded supporting member supporting the opposing member; and an auxiliary member made of a conductive material having a higher electric resistance than the opposing member. The opposing member and the supporting member are rendered electrically conductive to each other only via the auxiliary member.

DETAILED DESCRIPTION OF THE PREFERRED EMBODIMENTS

Next are described preferred embodiments of the present invention in detail with reference to the drawings. Note that the same reference numbers are used throughout the drawings to refer to the same or similar parts, and the description of the same or similar parts will accordingly be simplified or omitted.

First Embodiment

With reference to FIGS. 1 through 10, a first embodiment of the present invention is described in detail.

First, the overall structure and operations of the image forming apparatus are explained with reference to FIG. 1.

Figure 1:
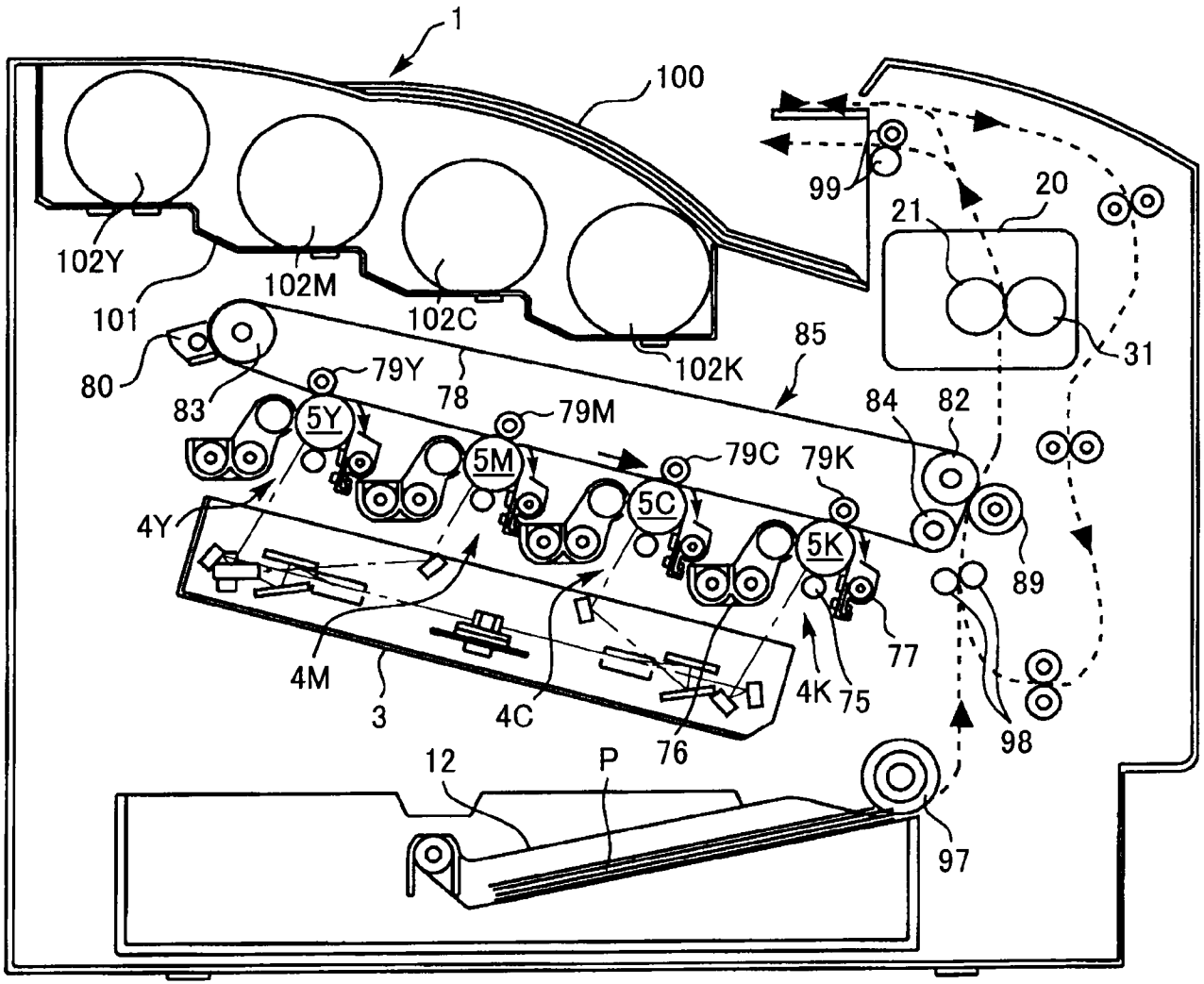
FIG. 1 is an overall structural diagram of an image forming apparatus according to a first embodiment of the present invention.

As shown in FIG. 1, an image forming apparatus 1 of the first embodiment is a tandem color printer. In a bottle housing unit 101 at the upper part of the image forming apparatus 1, four toner bottles 102Y, 102M, 102C and 102K corresponding to respective colors (yellow, magenta, cyan and black) are provided in a detachable (exchangeable) manner. An intermediate transfer unit 85 is arranged below the bottle housing unit 101. Image forming units 4Y, 4M, 4C and 4K, each of which forms an image of a corresponding color (yellow, magenta, cyan or black), are arranged parallel to each other to oppose an intermediate transfer belt 78 of the intermediate transfer unit 85.

In the image forming units 4Y, 4M, 4C and 4K, corresponding photosensitive drums 5Y, 5M, 5C and 5K are provided. A charging unit 75, a developing unit 76, a cleaning unit 77, a neutralization unit (not shown) and the like are disposed around each of the respective photosensitive drums 5Y, 5M, 5C and 5K. Image forming processing (a charging operation, an exposing operation, a developing operation, a transfer operation and a cleaning operation) is performed on the respective photosensitive drums 5Y, 5M, 5C and 5K, whereby images of corresponding colors are formed on the photosensitive drums 5Y, 5M, 5C and 5K.

The photosensitive drums 5Y, 5M, 5C and 5K are driven to rotate in a clockwise direction in FIG. 1 by a drive motor (not shown). Then, at the position of the corresponding charging unit 75, the entire surface of each photosensitive drum 5Y, 5M, 5C or 5K is electrically charged (Charging Operation).

Subsequently, the surface of each photosensitive drum 5Y, 5M, 5C or 5K reaches a position at which a laser light L emitted from an exposing unit 3 is incident to scan over the photosensitive drum 5Y, 5M, 5C or 5K. Herewith, an electrostatic latent image corresponding to each color is formed (Exposing Operation).

Next, the surface of the photosensitive drum 5Y, 5M, 5C or 5K reaches a position opposing the developing unit 76, at which the electrostatic latent image is developed to be a toner image of the corresponding color (Developing Operation).

Then, the surface of the photosensitive drum 5Y, 5M, 5C or 5K reaches a position opposing the intermediate transfer belt 78 and a primary transfer bias roller 79Y, 79M, 79C or 79K, at which the toner image on the photo sensitive drum 5Y, 5M, 5C or 5K is transferred to the intermediate transfer belt 78 (First Transfer Operation) At this point, a small amount of non-transferred toner remains on the photosensitive drum 5Y, 5M, 5C or 5K.

Subsequently, the surface of the photosensitive drum 5Y, 5M, 5C or 5K reaches a position opposing the corresponding cleaning unit 77, at which the remaining non-transferred toner on the photosensitive drum 5Y, 5M, 5C or 5K is mechanically collected by a cleaning blade of the cleaning unit 77 (Cleaning Operation).

Finally, the surface of the photosensitive drum 5Y, 5M, 5C or 5K reaches a position opposing the corresponding neutralization unit (not shown), at which a residual potential on the photosensitive drum 5Y, 5M, 5C or 5K is removed. Thus, a series of image forming processes performed on each photosensitive drum 5Y, 5M, 5C or 5K is completed.

Then, toner images of colors formed on the corresponding photosensitive drums 5Y, 5M, 5C and 5K after the developing operation are sequentially superposed one on top of the other and transferred to the intermediate transfer belt 78. Thus, a color image is formed on the intermediate transfer belt 78.

The intermediate transfer unit 85 includes, for example, the intermediate transfer belt 78, four primary transfer bias rollers 79Y, 79M, 79C and 79K, a secondary transfer backup roller 82, a cleaning backup roller 83, a tension roller 84, and an intermediate transfer cleaning unit 80. The intermediate transfer belt 78 is suspended and supported in a tensioned manner by three rollers 82, 83 and 84, and moves in the direction of the arrow in FIG. 1 in an endless manner when one roller 82 is driven to rotate.

The four primary transfer bias rollers 79Y, 79M, 79C and 79K form primary transfer nips with the photosensitive drums 5Y, 5M, 5C and 5K, respectively, with the intermediate transfer belt 78 interposed between them. Then, a transfer bias having a polarity opposite to a polarity of a toner is applied to each primary transfer bias roller 79Y, 79M, 79C or 79K.

The intermediate transfer belt 78 moves in the direction of the arrow to sequentially pass the primary transfer nips of the primary transfer bias rollers 79Y, 79M, 79C and 79K. Thus, toner images of colors formed on the corresponding photosensitive drums 5Y, 5M, 5C and 5K are sequentially superposed one on top of the other and primary-transferred to the intermediate transfer belt 78.

Subsequently, the intermediate transfer belt 78 on which the toner images of colors have been transferred reaches a position opposing a secondary transfer roller 89. At this position, the secondary transfer backup roller 82 forms a secondary transfer nip (transfer unit) with the secondary transfer roller 89, with the intermediate transfer belt 78 interposed between them. The toner images of the four colors formed on the intermediate transfer belt 78 are transferred to a recording medium P fed into the secondary transfer nip (Secondary Transfer Operation). At this point, toner not transferred to the recording medium P remains on the intermediate transfer belt 78.

Then, the intermediate transfer belt 78 reaches the intermediate transfer cleaning unit 80, by which the non-transferred toner on the intermediate transfer belt 78 is collected.

Thus, a series of transfer operations performed on the intermediate transfer belt 78 is completed.

The recording medium P fed into the secondary transfer nip is sent from a sheet feeding unit 12 provided at the lower part of the image forming apparatus 1 through a sheet feeding roller 97, paired resist rollers 98 and the like.

Specifically, multiple sheets of recording media P, such as transfer paper, are stacked and housed in the sheet feeding unit 12. Then, when the sheet feeding roller 97 is driven to rotate in a counterclockwise direction in FIG. 1, a top recording medium P is fed into the paired resist rollers 98.

When fed into the paired resist rollers 98, the recording medium P stops temporarily at a roller nip of the paired resist rollers 98 whose rotation is stopped. Then, the paired resist rollers 98 are driven to rotate at a timing to synchronize with the color image on the intermediate transfer belt 78, and the recording medium P is conveyed toward the secondary transfer nip. Thus, a desired color image is transferred to the recording medium P.

Subsequently, the recording medium P, on which the color image has been transferred at the secondary transfer nip, is fed into a nip portion (at which the fixing roller 21 abuts the pressure roller 31) of a fixing unit 20. Then, at the nip portion (fixing nip portion), the transferred color image is fixed onto the surface of the recording medium P by heat and pressure of the fixing roller 21 and the pressure roller 31 (Fixing Operation).

Next, the recording medium P is discharged to the outside of the image forming apparatus 1 through paired discharging rollers 99. The image-transferred recording media P discharged by the paired discharging rollers 99 to the outside of the image forming apparatus 1 are sequentially stacked in a stacking unit 100 as output images.

Thus, a series of image forming processes performed in the image forming apparatus 1 is completed.

Next, the structure and operations of the fixing device 20 included in the image forming apparatus 1 are explained in detail with reference to FIGS. 2 through 8.

Figure 2:
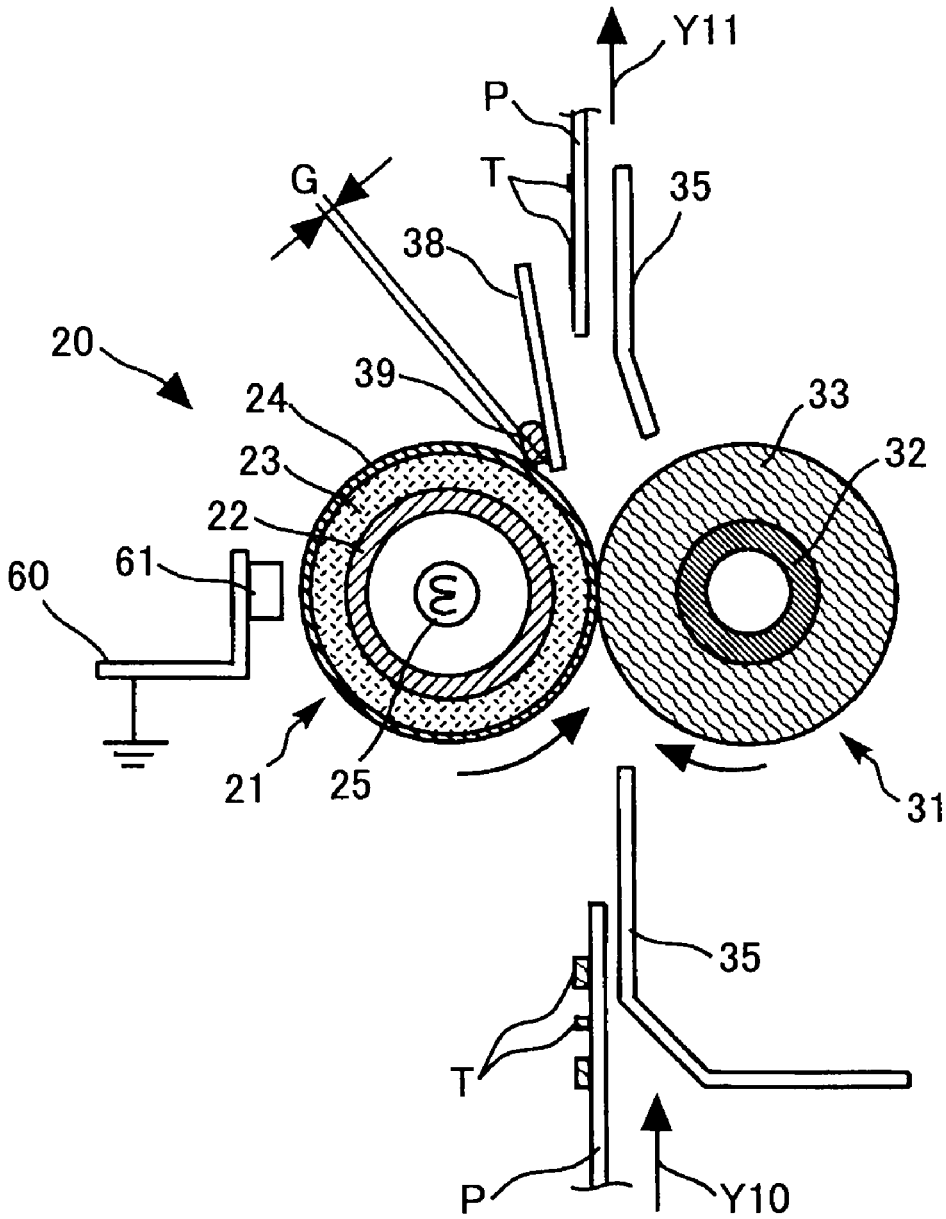
FIG. 2 is a structural diagram of a fixing device.
Figure 3:
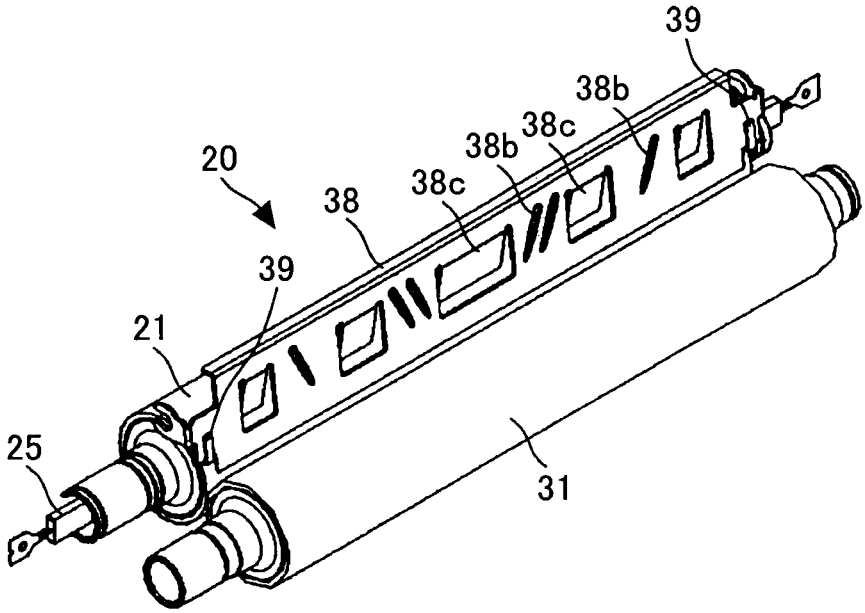
FIG. 3 is a perspective view of the fixing device.
Figure 4:
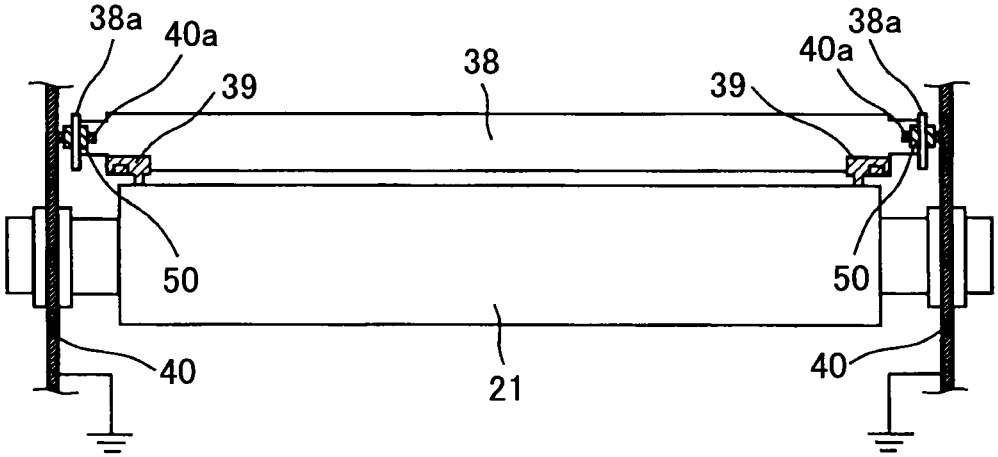
FIG. 4 is a schematic diagram showing a fixing roller and a separating plate in the width direction.
Figure 5:
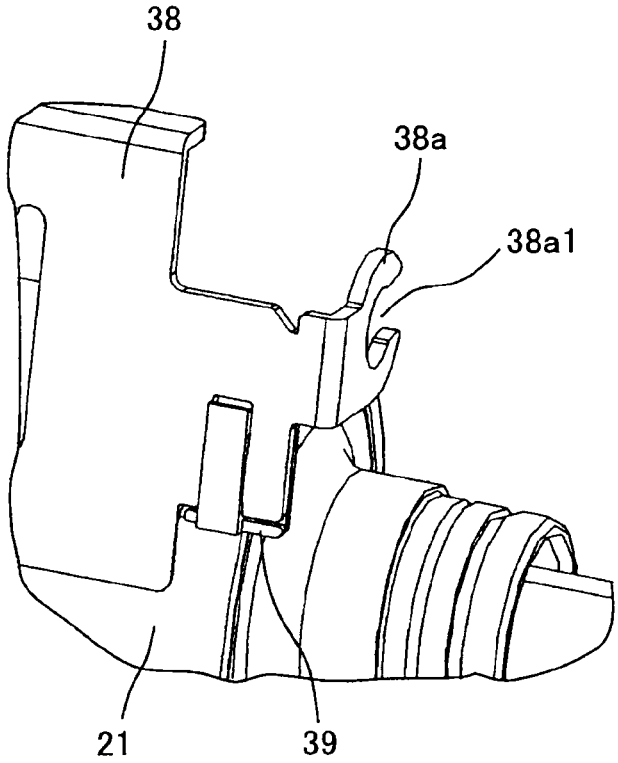
FIG. 5 is an enlarged perspective view of an end portion of the separating plate.
Figure 6:
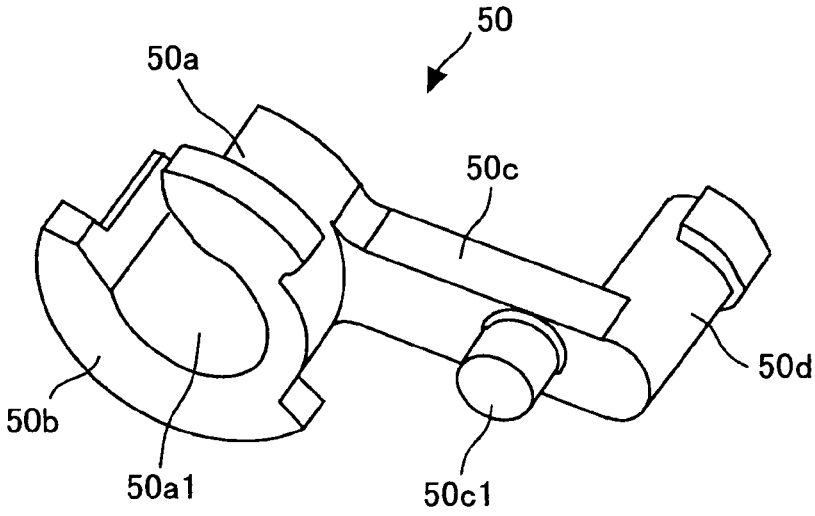
FIG. 6 is a perspective view of a conductive member.
Figure 7:
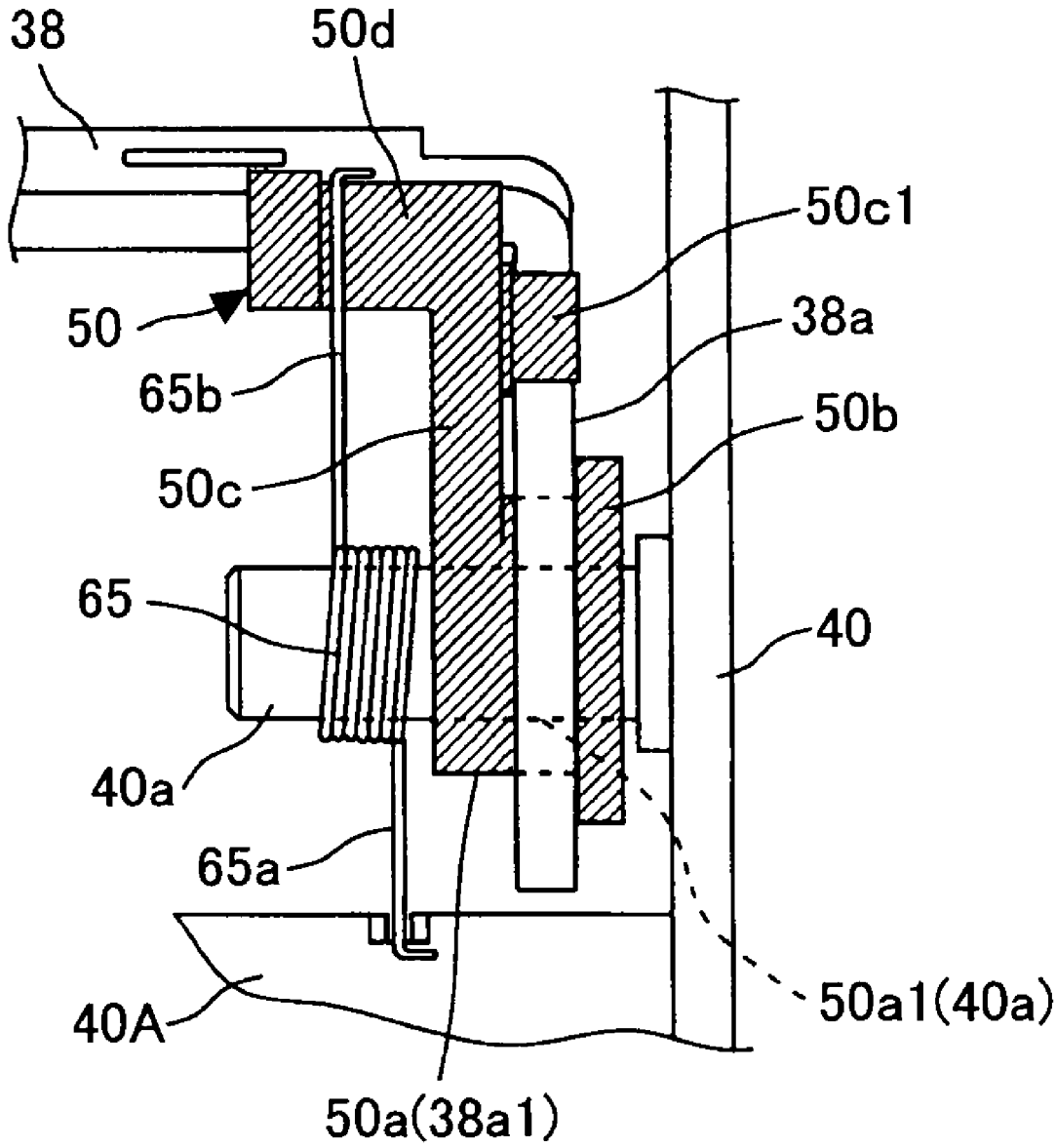
FIG. 7 is an enlarged view in which the conductive member is provided in the fixing device.

FIG. 2 is a structural diagram of the fixing device 20; FIG. 3 is a perspective view of the fixing device 20; FIG. 4 is a schematic diagram of the fixing roller 21 and a separating plate 38 in the width direction; FIG. 5 is an enlarged perspective view showing an end portion of the separating plate 38; FIG. 6 is a perspective view of a collar 50, which serves as a conductive member; FIG. 7 is an enlarged view in which the collar 50 is provided in the fixing device 20; and FIG. 8 shows a procedure for attaching the collar 50 to the separating plate 38.

As shown in FIGS. 2 through 4, the fixing device 20 includes, for example, the fixing roller 21 serving as a fixing member; the pressure roller 31 serving as a pressure member; the separating plate 38 serving as a separating member; a guide plate 35; a temperature sensor 61 serving as a detecting means; and frames 40.

The fixing roller 21 has a thin-walled cylindrical body which rotates in the direction of the arrow in FIG. 2. Inside the cylindrical body, a heater 25 (heat source) serving as a heating means is provided in a fixed manner. The fixing roller 21 is a multi-layered structure in which an elastic layer 23 and a mold-releasing layer 24 are sequentially stacked on a cored bar 22. The fixing roller 21 abuts the pressure roller 31 to form a nip portion.

The cored bar 22 of the fixing roller 21 is made of an iron-based material, such as SUS304.

The elastic layer 23 of the fixing roller 21 is made of an elastic material, for example, fluoro rubber, silicone rubber, or foamable silicone rubber.

The mold-releasing layer 24 of the fixing roller 21 may be made of PFA (tetrafluoroethylene perfluoroalkyl vinyl ether copolymer resin), polyimide, polyetherimide, PES (polyether sulfide) or the like. Providing the mold-releasing layer 24 as the surface of the fixing roller 21 secures a mold-releasing property (detachability) effective for the toner T (toner image).

The heater 25 (a heating means) of the fixing roller 21 is a halogen heater. The end portions of the fixing roller 21 are fixed onto the frames 40 of the fixing device 20. The fixing roller 21 is heated by the heater 25 whose power is controlled by a power unit (AC source) of the image forming apparatus 1, and heat is applied from the surface of the fixing roller 21 to the toner image T on the recording medium P. The power of the heater 25 is controlled based on the surface temperature of the fixing roller 21 detected by the temperature sensor 61 (a non-contact thermistor), which is disposed close to the surface of the fixing roller 21. Specifically, an AC voltage is applied to the heater 25 only during a conducting period determined based on the detection results by the temperature sensor 61. With this power control of the heater 25, the temperature of the fixing roller 21 (i.e. the fixing temperature) can be controlled and adjusted to a desired temperature (target control temperature). Note that as the temperature sensor 61, a non-contact thermoelectric pile or a contact-type thermistor may be used other than a non-contact thermistor.

The pressure roller 31 serving as a pressure member primarily includes a core bar 32 and an elastic layer 33 formed on top of an adhesive layer surrounding the outer surface of the cored bar 32. The elastic layer 33 of the pressure roller 31 is made of, for example, fluoro rubber, silicone rubber, or foamable silicone rubber. Note that a thin-walled mold-releasing layer made of PFA or the like may be provided on the surface of the elastic layer 33.

The pressure roller 31 abuts the fixing roller 21 due to the urging force of a pressure means (not shown). Thus, a desired nip portion is formed between the pressure roller 31 and the fixing roller 21.

Each of the fixing roller 21 and the pressure roller 31 is rotatably supported on the frames 40 via bearings (ball bearings). In the present embodiment, an individual set of frames is provided for each roller member although an illustration is omitted.

Specifically, the frames 40 (first frames) for the fixing roller 21 are separately provided one at each end portion of the fixing roller 21 and support the fixing roller 21 rotatably via bearings. Similarly, frames (second frames) for the pressure roller 31 (not shown) are separately provided one at each end portion of the pressure roller 31 and support the pressure roller 31 rotatably via bearings. The first frames 40 separately set up at the end portions of the fixing roller 21 are fastened to stays of the fixing device 20 by screws. The first frames 40 and the second frames on which the roller members 21 and 31 are respectively set are built up by engaging pins fixed onto the second frames with notches of the first frames 40 and screwing threaded rods (around which compression springs are wound) provided on the second frames into threaded receptacles on the first frames 40. In the fixing device 20 built up in this manner, the two roller members 21 and 31 abut each other, having their center at the position of the pins, due to the urging force of the compression spring (pressure means) to form a nip portion.

As shown in FIG. 4, the frames 40 (first frames) are electrically grounded, and the second frames (not shown) are also grounded via the first frames 40. Accordingly, the cored bar 22 of the fixing roller 21 and the cored bar 32 of the pressure roller 31 are electrically grounded via the bearings (inner rings, balls and outer rings of the ball bearings).

At the inlet side and outlet side of the abutting portion (i.e. nip portion) of the fixing roller 21 and the pressure roller 31, guide plates 35 for the conveyance of the recording medium P are provided. The guide plates 35 are fixed to the frames 40 of the fixing device 20.

On the downstream side (adjacent to the outlet of the nip portion) in the rotation direction of the fixing roller 21 in relation to the nip portion, the separating plate 38 serving as a separating member is provided to oppose the fixing roller 21 across a predetermined gap G. The separating plate 38 prevents the recording medium P after the fixing operation from winding around the fixing member 21 due to the rotation of the fixing member 21. The separating plate 38 is made of a metallic material.

With reference to FIGS. 3 through 5, positioning members 39 (projection members) for setting the gap G between the separating plate 38 and the fixing roller 21 are provided at the end portions of the separating plate 38 in the width direction (the direction perpendicular to the page in FIG. 2). The positioning members 39 are indirectly urged by torsion coil springs (see FIG. 7) provided at the end portions of the separating plate 38 (i.e. urged toward the fixing roller 21 together with the separating plate 38), thereby abutting the end portions of the fixing roller 21 in the width direction. Herewith, the gap G corresponding to the thickness of the positioning members 39 (inserted between the separating plate 38 and the fixing roller 21) is formed.

The gap G between the fixing roller 21 and the separating plate 38 is set to be 0.1 to 0.8 mm at the time when the fixing roller 21 is heated (completely heated). That is, the gap G is set to be 0.1 to 0.8 mm at the time when the components including the fixing roller 21, separating plate 38, positioning members 39 and the like are thermally expanded after the fixing device 20 is put into operation. If the gap G is less than 0.1 mm, dirt on the fixing roller 21 may be transferred to the separating plate 38, staining the recording medium P after the fixing operation, or the separating plate 38 may come in contact with the fixing roller 21, scratching and thus damaging the surface of the fixing roller 21. If the gap G is more than 0.8 mm, the primary function of the separating plate 38 to prevent the recording medium P from winding around the fixing roller 21 is thwarted. Note that the positioning members 39 are preferably made of an insulating and heat-resistant resin material.

As shown in FIG. 4, the separating plate 38 serving as a separating member is supported on the frames 40 via collars 50 (conductive members). Specifically, the collars 50 are inserted between pin portions 40*a* (supporting portions) of the frames 40 and supported portions 38*a* of the separating plate 38 (also see FIG. 7). The structure and movement of the collars 50 are described in detail below.

The fixing device 20 structured in the above-described manner operates as follows.

When a power switch of the image forming apparatus 1 is turned on, an AC voltage is applied (fed) to the heater 25 from the AC source, and the fixing roller 21 and the pressure roller 31 are driven to rotate in the respective directions of the arrows in FIG. 2.

Subsequently, the recording medium P is fed from the sheet feeding unit 12, and an unfixed image T (toner image) is transferred to the recording medium P at the secondary transfer nip. The recording medium P on which the unfixed image T is carried (i.e. the recording medium P after the secondary transfer operation) is conveyed in the direction of the arrow Y10 in FIG. 2, and then sent to the fixing nip portion of the fixing roller 21 and the pressure roller 31 abutting each other. Subsequently, the toner image T is fixed onto the surface of the recording medium P by heat of the fixing roller 21 and pressure of the fixing roller 21 and the pressure roller 31. Then, the recording medium P is sent out from the nip portion by the rotation of the fixing roller 21 and pressure roller 31, and is then conveyed in the direction of the arrow Y11.

Next are described characteristic structure and operations of the fixing device 20 according to the present embodiment.

The separating plate 38 serving as a separating member is supported on the frames 40 via the collars 50 serving as conductive members. Specifically, the collars 50 are inserted between the pin portions 40*a* (supporting portions) of the frames 40 and the supported portions 38*a* of the separating plate 38 (also see FIG. 7). The collars 50 have a higher electric resistance than that of the frames 40 (which are electrically grounded). The separating plate 38 and the frames 40 are rendered electrically conductive to each other only via the collars 50. For example, the surface resistance of the collars 50 is set to about 100 MΩ and the combined resistance of the separating plate 38 is set to about 50 MΩ.

Assume that the length of the recording medium P along the conveyance direction is long in relation to the distance on the conveyance path between the secondary transfer nip (transfer unit) and the separating plate 38 (i.e. the separating operation by the separating plate 38 is being carried out at the front end of the recording medium P while the secondary transfer operation is being carried out by the transfer unit at the rear end of the recording medium P). According to the above-described structure of the present embodiment, even if the recording medium P having high moisture content is fed under this condition, a transfer current applied to the secondary transfer roller 89 is less likely to leak to the separating plate 38 via the recording medium P. That is to say, since the separating plate 38 is rendered electrically conductive to the grounded frames 40 only via the conductive members 50 having a higher resistance, the transfer current does not instantly flow toward the frames 40 (ground side) via the recording medium P and the separating plate 38, and the separating plate 38 is temporarily charged with an electric potential via the recording medium P due to the transfer current. At the point when the charge amount of the separating plate 38 reaches a predetermined amount, the electric charges flow toward the frames 40 (ground side) via the collars 50, whereby the electric potential of the separating plate 38 decreases.

Accordingly, it is possible to prevent transfer defects, such as defects in image transfer density, at the secondary transfer nip (transfer unit) due to leakage of the transfer current to the separating plate 38 via the recording medium P. In addition, according to the present embodiment, the combined resistance of the separating plate 38 is set high by not using an electric resistor but using the collars 50. Therefore, it is possible to achieve the above-described effect with a relatively small space, without interrupting the rotation of the separating plate 38.

Figure 9:
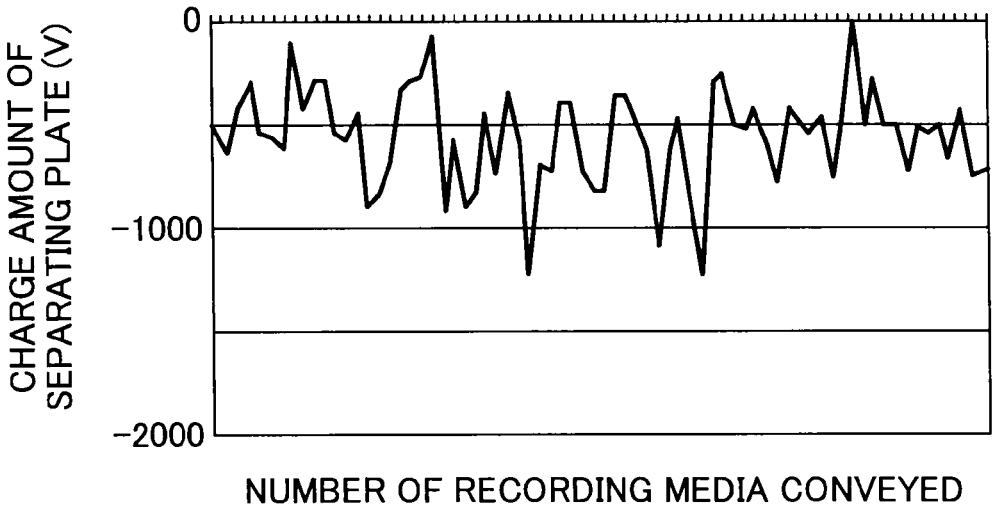
FIG. 9 is a graph showing variation in a charge amount of the separating plate measured according to one embodiment of the present invention.

FIG. 9 is a graph of an experimental result of the present embodiment showing variation in the charge amount (electric potential) of the separating plate 38 measured using the fixing device 20 of the present embodiment in which the recording media P were continuously conveyed. Each of the recording media P was longer than the distance between the secondary transfer nip and the separating plate 38 (e.g. recording media in A4 vertical). Note that the combined resistance of the separating plate 38 was 50 MΩ. The moisture content of the recording media P used was 12% or more.

According to the results of the experiment shown in FIG. 9, the following can be understood: during the conveyance of the recording media P when one of the recording media P is in contact with both the separating plate 38 and the secondary transfer nip, the separating plate 38 is electrically charged and its electric potential increases; and during a break between the recording media P when no recording medium P is in contact with both the separating plate 38 and the secondary transfer nip, the electric charges accumulated in the separating plate 38 flow toward the frames 40 via the collars 50 (conductive members), whereby the electric potential of the separating plate 38 decreases. In this experiment, no transfer defects, such as defects in image transfer density, on the output images were detected.

Therefore, it is preferable that the electric resistance of the collars 50 serving as conductive members be such that a transfer defect at the transfer unit can be prevented even if the moisture content of the recording medium P is 12% or more, on which recording medium P the separating operation by the separating plate 38 and the transfer operation by the transfer unit are performed at the same time.

Figure 10:
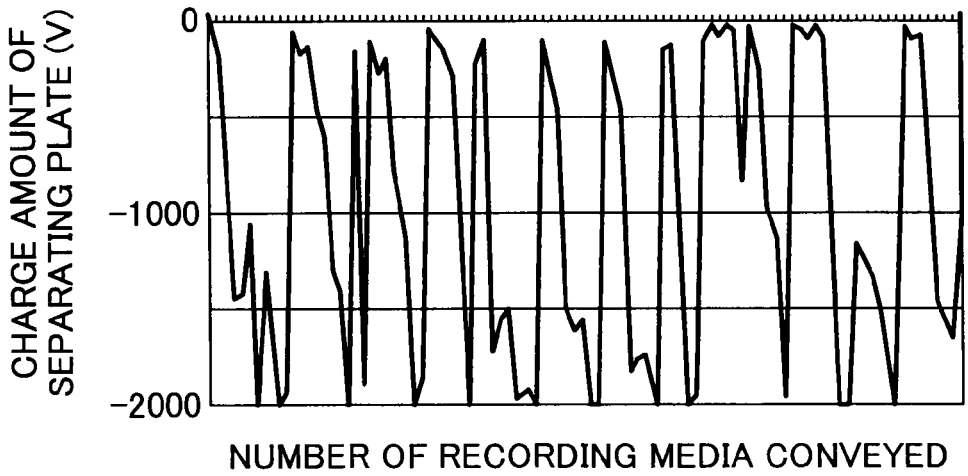
FIG. 10 is a graph showing variation in the charge amount of the separating plate measured according to a comparative example.

FIG. 10 is a graph (an experimental result of a comparative example) showing variation in the charge amount (electric potential) of the separating plate 38 measured using the fixing device 20 of the present embodiment in which the collars inserted between the separating plate 38 and the frames 40 were made of an insulating material. The experiment was performed in the same manner as in FIG. 9.

According to the experimental result shown in FIG. 9, the following can be understood: the separating plate 38 is electrically charged to have an electric potential larger than its capacitance (i.e. charged with up to −2 kV), and the electric charges accumulated in the separating plate 38 jump the insulating collars and flow toward the frames 40, whereby the electric potential of the separating plate 38 is reduced to 0 V at once. It was observed during the experiment that at the point when the electric potential was reduced to 0 V at once, noise occurred in electric components adjacent to the fixing device 20, and the writing time of the exposing unit 3 became out of sync.

Therefore, it is preferable that the electric resistance of the collars 50 be such that the separating plate 38 is not charged with an electric potential larger than its capacitance.

Note that, in the present embodiment, both collars 50 inserted between the separating plate 38 and the frames 40 are made of a conductive material having a high resistance; however, one of them may be an insulating member made of an insulating material. For example, a conductive member having a high resistance (e.g. the collar 50 on the right in FIG. 4) may be inserted between the first supporting portion 40*a* of the frame 40 and the first supported portion 38*a* of the separating plate 38, and an insulating member (e.g. the collar 50 on the left in FIG. 4) may be inserted between the second supporting portion 40*a* of the frame 40 and the second supported portion 38*a* of the separating plate 38. In this case also, the separating plate 38 and the frames 40 are rendered electrically conductive to each other only via the conducting collar 50 (conductive member), and the combined resistance of the separating plate 38 is high. As a result, the same effect as described above can be obtained.

The structures and movements of the separating plate 38, collars 50 (conductive members) and frames 40 are described below further in detail.

With reference to FIG. 5, the supported portions 38*a* for supporting the collars 50 are provided at both ends of the separating plate 38. Particularly, a hole 38*a*1 having a notch is formed in each supported portion 38*a*, and a hollow shaft potion 50*a* (outside diameter part) of the collar 50 engages the hole 38*a*1 (also see FIG. 7).

With reference to FIG. 7, on each frame 40, the pin portion 40*a* serving as a supporting portion projects, and a hollow shaft portion 50*a* (inside diameter part 50*a*1) of the collar 50 engages the pin portion 40*a*.

Also, a torsion coil spring 65 is wound (supported) around the pin portion 40*a* of the frame 40. One arm 65*a* of the torsion coil spring 65 abuts a frame member 40A (a stay connecting both frames 40) of the fixing device 20. The other arm 65*b* of the torsion coil spring 65 abuts a hook portion 50*d* of the collar 50. According to such a structure, the urging force of the torsion coil spring 65 is transmitted to the separating plate 38 via the collar 50, whereby the separating plate 38 together with the positioning member 39 is urged toward the fixing roller 21. Accordingly, the gap G between the separating plate 38 and the fixing roller 21 is stably established by the positioning members 39 at both ends. Since the torsion coil spring 65 usually made of a metallic material is out of contact with the separating plate 38, the torsion coil spring 65 has no effect on the combined resistance of the separating plate 38.

With reference to FIG. 6, the collar 50 serving as a conductive member includes, for example, the hollow shaft portion 50*a*, a flange portion 50*b*, an arm portion 50*c*, and the hook portion 50*d*.

The outside diameter part of the hollow shaft portion 50*a* engages the hole 38*a*1 of the supported portion 38*a* of the separating plate 38. The inside diameter part 50*a*1 of the hollow shaft portion 50*a* engages the pin portion 40*a* (supporting portion) of the frame 40. A notch is formed in the hollow shaft portion 50*a*.

The flange portion 50*b* is formed on the hollow shaft portion 50*a*, and abuts the supported portion 38*a* of the separating plate 38 (also see FIG. 7).

The arm portion 50*c* couples the hollow shaft portion 50*a* with the hook portion 50*d*. On the arm portion 50*c*, a boss portion 50*c*1 is formed, which abuts the separating plate 38 and controls the rotation of the separating plate 38 around the hollow shaft portion 50*a* (see also FIGS. 7 and 8C).

The hook portion 50*d* is pressed by one arm portion 65*b* of the coil spring 65, as described above.

With reference to FIG. 7, the arm portion 50*c* and the flange portion 50*b* are designed to hold the supported portion 38*a* of the separating plate 38 between them. Herewith, the contact between the separating plate 38 and the collar 50 becomes stable, and the combined resistance of the separating plate 38 also becomes stable. As a result, the effect to prevent the above-mentioned defects in image transfer density can be ensured.

Figure 8A:
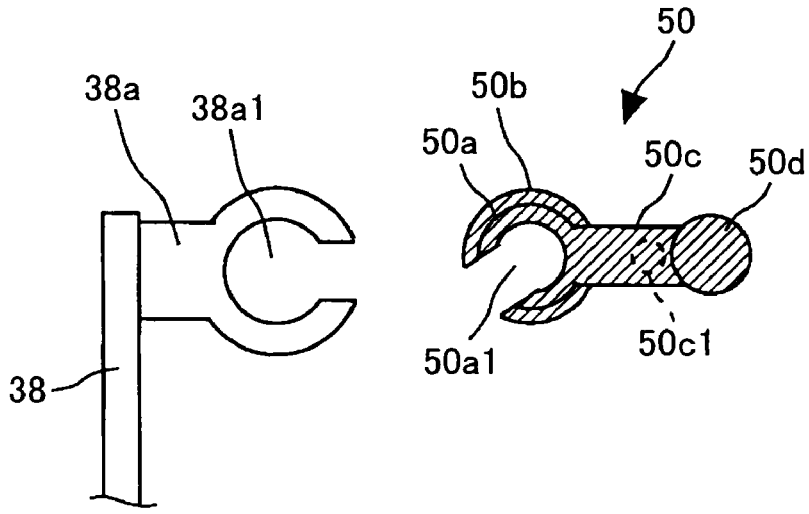
FIGS. 8A through 8C show a procedure for fitting the conductive member on the separating plate.
Figure 8B:
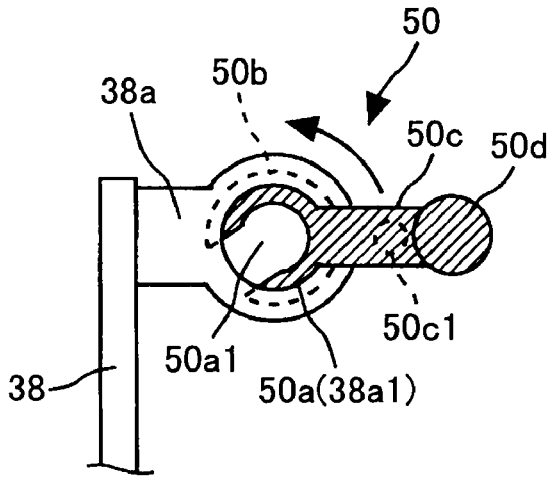
Figure 8C:
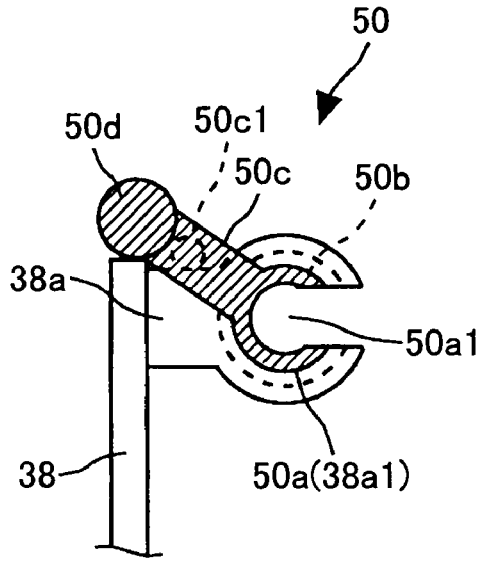

The collars 50 structured in this manner are set on the separating plate 38 according to the procedure shown in FIGS. 8A through 8C.

First, the hollow shaft portion 50*a* of the collar 50 is moved toward the separating plate 38 in a perpendicular direction from the back to the front side of the page in FIG. 8, and inserted into the hole 38*a*1 so that the arm portion 50*c* of the collar 50 fits into the notch of the hole 38*a*1 of the separating plate 38 (transition from FIGS. 8A to 8B). At this point, the flange portion 50*b* of the collar 50 abuts the supported portion 38*a* of the separating plate 38.

Then, from the condition of FIG. 8B, the collar 50 is rotated in the arrow direction until the boss portion 50*c*1 abuts the supported portion 38*a* (FIG. 8C). At this point, the following conditions can be obtained: the hook portion 50*d* of the collar 50 abuts the separating plate 38; the arm portion 50*c* and flange portion 50*b* of the collar 50 hold the supported portion 38*a* between them; and the notch of the hollow shaft portion 50*a* aligns with the notch of the hole 38*a*1 of the separating plate 38.

Thus, the collar 50 can be readily provided in a small space between the separating plate 38 and the frame 40 by a relatively simple structure.

In the present embodiment, the collars 50 serving as conductive members are made of conductive and heat-resisting PPS (polyphenylene sulfide) or PEI (polyetherimide) whose surface resistance is 108 to $10^{16}\Omega$. In the case of injection-molding the collars 50, the injection speed is maintained constant using a filler. According to such a structure, the collars 50 have a stable shape and exhibit a stable resistance even under a high-temperature environment.

In the present embodiment, ribs 38*b* (beads) and/or holes (38*c*) are formed on the lateral side of the separating plate 38 to face the recording medium P (i.e. the side opposing the conveying path of the recording medium P), as shown in FIG. 3. Herewith, the area of contact between the separating plate 38 and the recording medium P is reduced, whereby the leakage of the transfer current can be reduced.

Furthermore, in the present embodiment, it is preferable to use the separating plate 38 on which a coating process has been provided so that the surface resistance of the lateral side facing the recording medium P is $1\times10^{16}\Omega$ or larger. Herewith, the flow of the transfer current is reduced.

In the present embodiment, a support plate 60 is a metallic member supporting the temperature sensor 61 for detecting the temperature of the fixing roller 21, and is electrically grounded, as shown in FIG. 2. Herewith, the temperature sensor 61 is immune to static electricity due to the conveyance of the recording media P and disturbance, and is therefore protected from malfunction. In the case where a heater is internally provided in the pressure roller 31 and the surface temperature of the pressure roller 31 is detected by a temperature sensor (detection means), it is preferable that a metallic member supporting the temperature sensor also be grounded.

As has been described above, according to the present embodiment, the collars 50 (conductive members) having a higher electric resistance than that of the electrically grounded frames 40 are inserted between the supporting portions 40*a* of the frames 40 and the supported portions 38*a* of the separating plate 38 (separating member), whereby the separating plate 38 and the frames 40 are rendered electrically conductive to each other only via the collars 50. Accordingly, it is possible to prevent a reduction in the function of the separating plate 38; an increase in cost and size of the fixing device 20; and transfer defects at the transfer unit, such as defects in image transfer density.

Second Embodiment

Figure 11:
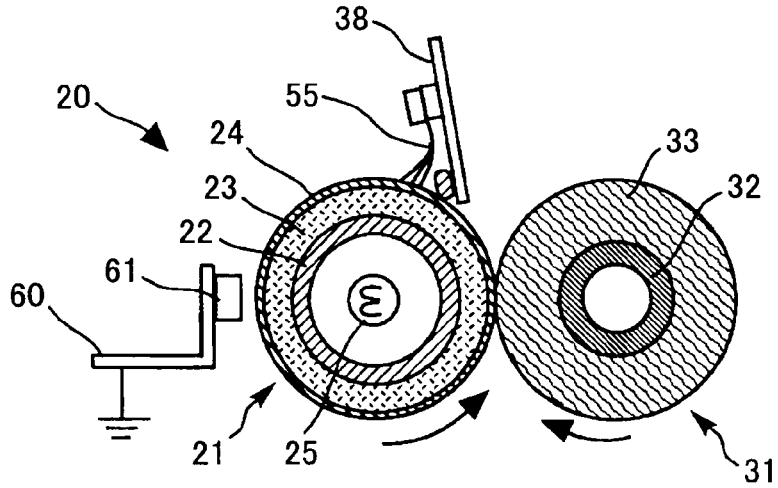
FIG. 11 is a structural diagram of a fixing device according to a second embodiment of the present invention.

With reference to FIG. 11, a second embodiment of the present invention is explained in detail.

FIG. 11 shows a structure of a fixing device according to the second embodiment, and corresponds to FIG. 2 of the first embodiment. The fixing device of the second embodiment is different from that of the first embodiment in that a neutralization member 55 is provided on the separating member 38.

As in the first embodiment, the fixing device of the second embodiment includes, for example, the fixing roller 21 (fixing member), the pressure roller 31 (pressure member), the separating plate 38 (separating member), the guide plate 35, the temperature sensor 61 (detection means) and the frames 40. The separating plate 38 is supported on the grounded frames 40 via the collars 50 serving as conductive members, and the combined resistance of the separating plate 38 is about 50 MΩ.

In the present embodiment, a neutralizing brush 55, which serves as a neutralizing member and abuts the fixing roller 21, is provided on the non-conveyance lateral side of the separating plate 38 (i.e. opposite from the side facing the conveying path of the recording medium P). Herewith, it is possible to reduce the number of parts required for grounding the neutralizing brush 55 via a conducting material. That is to say, electric charges occurring on the surface of the fixing roller 21 are temporarily accumulated in the neutralizing brush 55 (or the separating plate 38), and the accumulated electric charges flow toward the frames 40 (ground side) via the collars 50 (conductive members).

Note that it is preferable that the neutralizing brush 55 (neutralizing member) be connected to the separating plate 38 via a current rectification means, such as a diode. Specifically, the current rectification means is provided so that electric charges are not transferred toward the fixing roller 21 (the neutralizing brush 55) from the separating plate 38. Herewith, the electric charges accumulated in the separating plate 38 can be prevented from flowing backward toward the fixing roller 21 (the neutralizing brush 55), and thus the normal flow channel toward the frames 40 (ground side) via the collars 50 (conductive members) can be maintained.

Thus, according also to the second embodiment, as in the first embodiment described above, the collars 50 (conductive members) having a higher electric resistance than that of the electrically grounded frames 40 are inserted between the supporting portions 40*a* of the frames 40 and the supported portions 38*a* of the separating plate 38 (separating member), whereby the separating plate 38 and the frames 40 are rendered electrically conductive to each other only via the collars 50. Accordingly, it is possible to prevent a reduction in the function of the separating plate 38; an increase in cost and size of the fixing device 20; and transfer defects at the transfer unit, such as defects in image transfer density.

Third Embodiment

Figure 12:
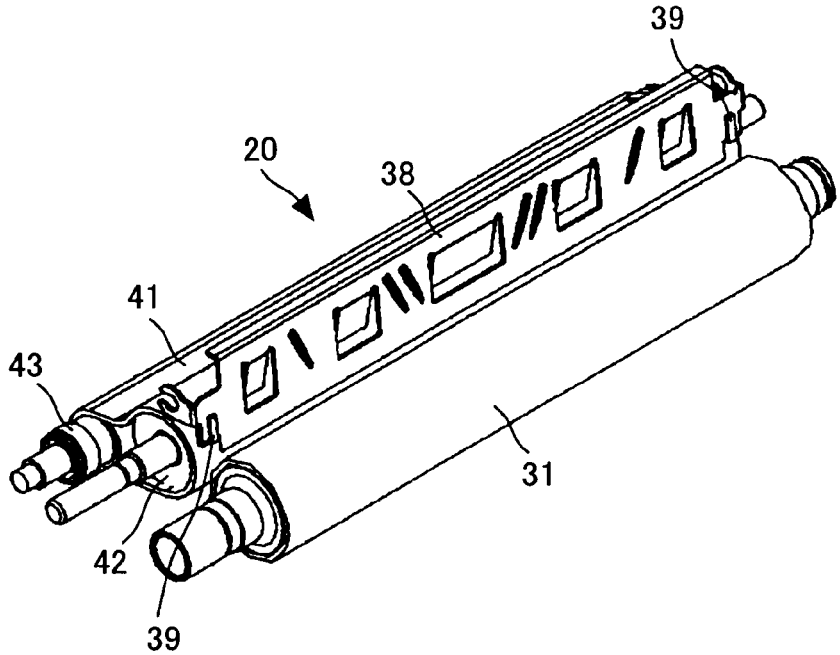
FIG. 12 is a structural diagram of a fixing device according to a third embodiment of the present invention.

With reference to FIG. 12, a third embodiment of the present invention is explained in detail.

FIG. 12 is a perspective view of a fixing device of the third embodiment, and corresponds to FIG. 3 of the first embodiment. The fixing device of the third embodiment is different in using a fixing belt 41 as the fixing member, compared to each previous embodiment in which the fixing roller 21 is used as the fixing member.

As shown in FIG. 12, the fixing device 20 according to the third embodiment includes, for example, the fixing belt 41 serving as a fixing member, a fixing auxiliary roller 42, a heating roller 43, the pressure roller 31 serving as a pressure member, a tension roller (not shown), the separating plate 38 serving as a separating member, and frames (not shown).

The fixing belt 41 is an endless multilayered belt which is created by sequentially stacking an elastic layer and a mold-releasing layer on top of the base layer of 90 μm in thickness made of a polyimide resin. The elastic layer of the fixing belt 41 is about 200 μm in thickness, and is made of an elastic material, such as silicone rubber, fluoro rubber, or foamable silicone rubber. The mold-releasing layer of the fixing belt 41 is about 20 μm in thickness, and is made of PFA (tetrafluoroethylene perfluoroalkyl vinyl ether copolymer resin), polyimide, polyetherimide, PES (polyether sulfide) or the like. Providing the mold-releasing layer as the surface of the fixing belt 41 secures a mold-releasing property (detachability) effective for toner T (toner image). The fixing belt 41 is suspended and supported in a tensioned manner by multiple roller members (i.e. the fixing auxiliary roller 42, the heating roller 43 and the tension roller), and moves in a predetermined direction.

The fixing auxiliary roller 42 has a cylindrical body with an outside diameter of 52 mm, which is created by forming an elastic layer (14 mm in layer thickness) made of fluoro rubber, silicone rubber, foamable silicone rubber or the like on top of a cored bar made, for example, of SUS304. The fixing auxiliary roller 42 abuts the pressure roller 31 serving as a pressure member with the fixing belt 41 interposed between them, to thereby form a fixing nip portion.

The heating roller 43 has a cylindrical body (0.6 mm in wall thickness and 35 mm in outside diameter) made of a metallic material, such as aluminum, and a heater (heat source) is provided inside the cylindrical body in a fixed manner.

The heater of the heating roller 43 is a halogen heater, and the end portions are fixed onto the frames of the fixing device 20. The heating roller 43 is heated by radiation heat from the heater whose power is controlled by a power unit (AC source) of the image forming apparatus 1, and heat is applied to the toner image T on the recording medium P from the surface of the fixing belt 41 heated by the heating roller 43. The power control of the heater is performed based on the surface temperature of the fixing belt 41 detected by a non-contact thermoelectric pile (not shown) opposing the surface of the fixing belt 41. Specifically, an AC voltage is applied to the heater only during a conducting period determined based on the surface temperature detected by the thermoelectric pile. With this power control on the heater, the temperature (fixing temperature) of the fixing belt 41 can be controlled and adjusted to a desired temperature (target control temperature).

The pressure roller 31 serving as a pressure member is created by forming an elastic layer 1.5 mm in thickness made of silicone rubber, fluoro rubber, or foamable silicone rubber on a hollow cored bar with a wall thickness of 1 mm.

Due to a pressure mechanism, the pressure roller 31 abuts the fixing auxiliary roller 42 with the fixing belt 41 interposed between them. Herewith, a desired fixing nip portion is formed between the pressure roller 31 and the fixing belt 41.

On the downstream side (adjacent to the outlet of the nip portion) in the moving direction of the fixing belt 41 in relation to the nip portion, the separating plate 38 is provided in a manner to oppose the fixing belt 41 across a predetermined gap.

Also in the third embodiment, the separating plate 38 is supported on the grounded frames 40 via the collars 50 serving as conductive members, and the combined resistance of the separating plate 38 is about 50 MΩ.

The fixing device 20 structured in the above-mentioned manner operates as follows.

When a power switch of the image forming apparatus 1 is turned on, an AC voltage is applied (fed) to the heater from the AC source, and the pressure roller 31 is driven to rotate by a drive motor (not shown), whereby the fixing belt 41 (the fixing auxiliary roller 42 and the heating roller 43) is driven to rotate.

Subsequently, the recording medium P is fed from the sheet feeding unit 12, and an unfixed image T (toner image) is transferred to the recording medium P at the secondary transfer nip (transfer unit). The recording medium P on which the unfixed image T is carried is fed into the nip portion at which the fixing belt 41 and the pressure roller 31 abut each other. Next, the toner image T is fixed onto the surface of the recording medium P by heat of the fixing belt 41 and pressure of the fixing belt 41 (the fixing auxiliary roller 42) and the pressure roller 31. Then, the recording medium P is sent out from the nip portion by the rotating fixing belt 41 and pressure roller 31.

Thus, according also to the third embodiment, as in each embodiment described above, the collars 50 (conductive members) having a higher electric resistance than that of the electrically grounded frames 40 are inserted between the supporting portions 40*a* of the frames 40 and the supported portions 38*a* of the separating plate 38 (separating member), whereby the separating plate 38 and the frames 40 are rendered electrically conductive to each other only via the collars 50. Accordingly, it is possible to prevent a reduction in the function of the separating plate 38; an increase in cost and size of the fixing device 20; and transfer defects at the transfer unit, such as defects in image transfer density.

In each of the embodiments described above, the present invention is applied to the fixing device 20 using the heater 25 as a heating means. However, the present invention may be positively applied to an electromagnetic induction heating fixing device using an exciting coil as a heating means.

Also in each of the embodiments described above, the present invention is applied to the fixing device 20 using the pressure roller 31 as its pressure member; however, the present invention may be applied to a fixing device using a pressure belt or a pressure pad as its pressure member.

In these cases also, the same effect described in each embodiment above can be obtained.

Also in each of the embodiments described above, the present invention is applied to the fixing device 20 including the separating plate 38 (serving as an opposing member) which is provided in the conveyance path of the recording medium P so as to face the recording medium P; the frames 40 (supporting members) which support the opposing member 38 and are electrically grounded; and the collars 50 (auxiliary members) made of a conducting material having a higher electric resistance than that of the opposing member 38. However, the application of the present invention is not limited to this case, and the present invention may be applied to any type of opposing member which is provided in the conveyance path of the recording medium P so as to face the recording medium P (particularly, an opposing member facing the transfer surface (i.e. the front side) of the recording medium P). That is, almost the same effect as in each of the above embodiments can be achieved by rendering the opposing member and the supporting members electrically conductive to each other only via the auxiliary members having a high resistance. Note that such opposing members include a front guide situated before the toner-image transfer unit, a conveyance guide plate, a resist guide plate, a bottom plate of the sheet feeding cassette and the like that are provided in the conveyance path of a recording medium.

Thus, the present invention has been described herein with reference to preferred embodiments thereof. While the present invention has been shown and described with particular examples, it should be understood that various changes and modification may be made to the particular examples without departing from the scope of the broad spirit and scope of the technological thought of the present invention. Moreover, the numbers of components, positions, and shapes are not limited to the above embodiments, and may be changed to preferable numbers of components, positions, and shapes to carry out the present invention.

This application is based on Japanese Patent Application No. 2007-279143 filed in the Japan Patent Office on Oct. 26, 2007, the contents of which are hereby incorporated herein by reference.

What is claimed is:

1. A fixing device comprising:

a fixing member configured to heat and melt a toner image to fix the toner image onto a recording medium;

a pressure member abutting the fixing member to form a nip portion into which the recording medium is fed;

a separating member disposed on a downstream side in a moving direction of the fixing member in relation to the nip portion in a manner to oppose the fixing member, and configured to perform a separating operation to prevent the recording medium from winding around the fixing member;

an electrically grounded frame supporting the fixing member, the pressure member and the separating member; and a conductive member inserted between a supporting portion of the frame and a supported portion of the separating member and having a higher electric resistance than the frame, wherein the separating member and the frame are rendered electrically conductive to each other only via the conductive member.

2. The fixing device as claimed in claim 1, further comprising:

an insulating member inserted between a second supporting portion of the frame and a second supported portion of the separating member.

3. The fixing device as claimed in claim 1, wherein the electric resistance of the conductive member is such that, in a case where the separating operation by the separating member and a toner-image transfer operation by a transfer unit are performed simultaneously on the recording medium, a transfer defect at the transfer unit is prevented even if the recording medium has a moisture content of 12% or more.

4. The fixing device as claimed in claim 1, wherein the electric resistance of the conductive member is such that the separating member is not charged with an electric potential larger than a capacitance thereof.

5. The fixing device as claimed in claim 1, wherein the conductive member is made of one of polyphenylene sulfide and polyetherimide.

6. The fixing device as claimed in claim 1, wherein the conductive member includes:

a hollow shaft portion engaging a hole of the supported portion of the separating member, and also engaging a pin portion of the supporting portion of the frame;

a flange portion disposed on the hollow shaft portion and abutting the supported portion of the separating member; and an arm portion connected to the hollow shaft portion and including a boss portion abutting the separating member to control rotation of the separating member around the hollow shaft portion.

7. The fixing device as claimed in claim 6, further comprising:

positioning members disposed on the separating member and abutting both end portions of the fixing member in a width direction in a manner to form a predetermined gap between the separating member and the fixing member; and a torsion coil spring supported on the frame and having one arm abutting the frame, wherein the conductive member further includes a hook portion which another arm of the torsion coil spring abuts, and an urging force of the torsion coil spring is transmitted to the separating member so that the separating member is urged toward the fixing member.

8. The fixing device as claimed in claim 6, wherein the supported portion of the separating member is held and supported between the arm portion and the flange portion of the conductive member.

9. The fixing device as claimed in claim 1, wherein one surface of the separating member opposing a conveyance path of the recording medium is coated so as to have a surface resistance of $1\times10^{16}\Omega$ or larger.

10. The fixing device as claimed in claim 1, wherein one surface of the separating member has either one of a rib and a hole, or both.

11. The fixing device as claimed in claim 10, wherein a neutralization member is disposed on another surface of the separating member opposite from the one surface in a manner to abut the fixing member.

12. The fixing device as claimed in claim 11, wherein the neutralization member is connected to the separating member via a current rectification unit.

13. The fixing device as claimed in claim 1, further comprising:

a detection unit configured to detect a temperature of either one of or both of the fixing member and the pressure member; and an electrically grounded metallic member supporting the detection unit.

14. An image forming apparatus including a fixing device comprising:

a fixing member configured to heat and melt a toner image to fix the toner image onto a recording medium;

a pressure member abutting the fixing member to form a nip portion into which the recording medium is fed;

a separating member disposed on a downstream side in a moving direction of the fixing member in relation to the nip portion in a manner to oppose the fixing member, and configured to perform a separating operation to prevent the recording medium from winding around the fixing member;

a frame electrically grounded and supporting the fixing member, the pressure member and the separating member; and a conductive member inserted between a supporting portion of the frame and a supported portion of the separating member and having a higher electric resistance than the frame, wherein the separating member and the frame are rendered electrically conductive to each other only via the conductive member.

15. An image forming apparatus comprising:

an opposing member disposed in a conveyance path of a recording medium so as to face the recording medium;

an electrically grounded supporting member supporting the opposing member; and an auxiliary member made of a conductive material having a higher electric resistance than the opposing member, wherein the opposing member and the supporting member are rendered electrically conductive to each other only via the auxiliary member.

* * * * *